United States Patent [19]

Erickson et al.

[11] 4,001,909

[45] Jan. 11, 1977

[54] CHILD'S TOOTHBRUSH HAVING A WHISTLE

[75] Inventors: Wallace A. Erickson, Chicago; David K. Erickson, Skokie, both of Ill.

[73] Assignee: Wallace A. Erickson Company, Chicago, Ill.

[22] Filed: Feb. 2, 1976

[21] Appl. No.: 654,217

[52] U.S. Cl. ..... 15/105; 15/143 B; 15/184; 46/179

[51] Int. Cl.[2] ..... A46B 17/04; G10K 5/00

[58] Field of Search ..... 15/105, 143 B, 144 B, 15/167 R, 184; 46/175, 179; D4/15, 18; D34/15 C

[56] References Cited

UNITED STATES PATENTS

| | | | |
|---|---|---|---|
| 1,597,742 | 8/1926 | Turner | 46/179 |
| 2,486,062 | 10/1949 | Ridner | 15/184 X |
| 2,651,070 | 9/1913 | Zimmerman | 15/184 X |
| 2,697,298 | 12/1954 | Bacon | 46/175 R X |
| 2,877,477 | 3/1959 | Levin | 15/105 |

*Primary Examiner*—Daniel Blum
*Attorney, Agent, or Firm*—Merriam, Marshall, Shapiro & Klose

[57] ABSTRACT

A combined toothbrush whistle having a bristle portion and a shaft with a cover adapted to fit over the slide relative to the shaft. The cover has an opening in the cover wall for producing musical notes and a sheath located at one end of the cover for covering the bristle portion.

3 Claims, 4 Drawing Figures

12
13
14
15
16
17
18
19
20
21
22
23
26
27
29
30
31
32
33
34
4
4

CHILD'S TOOTHBRUSH HAVING A WHISTLE

This invention relates to a device for brushing teeth and more particularly to a toothbrush having a cover with a sheath portion adapted to move relative to the shaft of the brush. The cover has an opening in it to provide a musical device of the whistle type.

It is often desired to find means of encouraging children to brush their teeth on a regular basis. Unfortunately, in many instances the act of brushing one's teeth is not one which is particularly attractive to a child, inasmuch as the child does not appreciate the benefits which result from regular brushing of the teeth. Accordingly, it is desirous to have some inducement which is associated with the act of brushing one's teeth which will be attractive to a child and will cause the child to brush his or her teeth because of the enjoyable act associated with the brushing operation. With the view of achieving a means of encouragement or an inducement, the invention disclosed and claimed herein relates to a toothbrush which has a movable elongated cover disposed over the shaft of the toothbrush. The cover wall has an opening in it whereby blowing on the open cover end will provide musical notes as one's breath forcibly goes through the opening in the cover wall. The device serves to achieve the desired result of inducing a child to brush his or her teeth because of the knowledge that there is a musical device associated with the act of brushing.

The brush device of the present invention also incorporates a sheath cover which is adapted to fit over the bristle portion of the brush, thereby serving to protect the bristles from contaminating objects. This is particularly desirable when one is on a trip or has some other occasion when the toothbrush is placed in a suitcase or other travel bag and it is desired not to have the brush bristles contact foreign objects.

These and other features and advantages of the invention will become apparent to those having ordinary skill in the art with reference to the drawings, description and appended claims.

DETAILED DESCRIPTION OF THE DRAWINGS

Figures 1, 2, 3, 4:
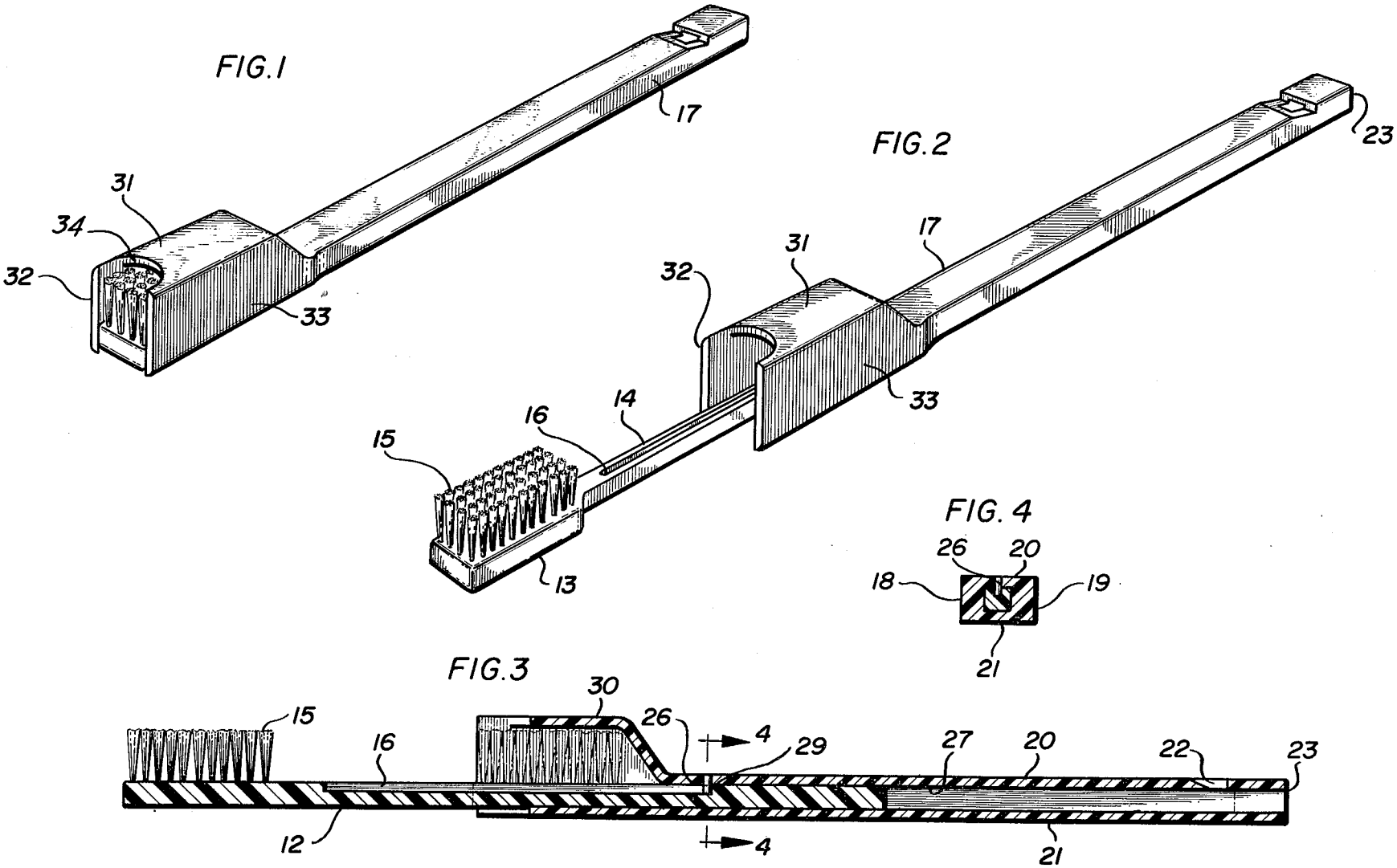
FIG. 1 shows a perspective view of the toothbrush of the present invention having a movable cover and protective sheath portion located on the brush with the whistle in an inoperative position.
FIG. 2 shows the toothbrush of FIG. 1 with the cover in an operative position whereby the whistle can be played.
FIG. 3 is a section side view of the toothbrush and cover device illustrated in FIG. 2; and, FIG. 4 shows a section view taken along lines 4—4 in FIG. 3.

Referring to the drawings, there is shown a toothbrush 12 having a bristle portion 13 and a shaft 14. Brush bristles 15 extend upward from portion 13. The toothbrush is much like any conventional toothbrush available commercially with the exception that the shaft portion is changed. As seen more clearly in FIGS. 2–4, the shaft portion has a groove 16 which extends along a substantial portion of the length of the shaft.

A cover 17 is adapted to fit snugly over shaft 14 and is adapted to slide along the length of the shaft. The cover comprises two side walls 18, 19, top wall 20 and bottom wall 21. The top wall of cover 21 has an opening 22 located close to the open, free or outboard end 23 of cover. The cover opening 22 is tapered with the taper running downward and toward the free end of the cover as seen, for example, in FIGS. 1 and 3.

Cover top wall 20 has a pin 26 depending from the inner wall 27 of the cover. The pin is adapted to fit within groove 16 and prevents the cover from moving beyond the limits established by the length of groove 16. As seen in FIG. 4, when the cover is pulled outwardly, the pin 26 will abut against end 29 of groove 16.

The remaining end of the cover opposite end 23 has a sheath portion 30 extending therefrom. The sheath portion is an elongation of the cover and is raised sufficiently so that it will fit snugly over brush bristles 15. The bottom of th sheath portion is a continuation of the bottom wall 21 of cover 17. The cover is open at the sheath end so that the sheath portion can be moved relative to the brush portion as seen in FIG. 3. Preferably, the sheath top wall 31 and side walls 32, 33 of the sheath will extend along the length of the bristle portion so that when the cover is in the position seen in FIG. 1, sheath portion 30 will cover the top and sides of the bristle portion of the toothbrush. The wall 31 has an actuating notch 34.

In operation, a child or other user of the brush can slide the cover along the shaft of the toothbrush to expose the bristles 15 for brushing. After the cleaning operation is completed, the child can then blow into the open end 23 of cover 17 with the result being that the air from the child's breath will be forced through opening 22 to provide a musical note. By moving cover 17 relative the shaft portion 14, one can play a range of musical notes. When the child is through with the brushing operation, the cover can be positioned so that the sheath portion 30 covers the brush bristles 15 as seen in FIG. 1.

While the device has been shown with a cover having a sheath, it is appreciated that the sheath portion is not required in order for the whistle to work.

The foregoing detailed description has been given for clearness of understanding only and no unnecessary limitations should be understood therefrom as modifications will be obvious to those skilled in the art.

What is claimed is:

1. A combined toothbrush and whistle device, said device comprising:

a brush having a bristle portion and a shaft;

a hollow cover adapted to fit over and slide relative to said shaft;

said cover having two ends, one which is an open, outboard end and a top, bottom and side walls;

said cover having a tapered opening in said top wall located near said outboard end, said taper running downward and toward the free end of the cover;

and means connecting said shaft portion and said cover whereby said cover is positioned to embrace said shaft and is adapted to move relative to said shaft portion to provide a whistle in which one can play a range of musical notes when air is blown into said open outboard end of said cover and the cover adjusted.

2. A device in accordance with claim 1 wherein said shaft has a groove along a substantial portion of its length; and said cover top wall has a pin depending therefrom;

said pin being adapted to fit in and slide within said groove.

3. A toothbrush in accordance with claim 1 wherein said cover has a sheath portion extending outward from said remaining cover end, said sheath portion having a shape to project the brush bristles when not in use.

* * * * *

UNITED STATES PATENT AND TRADEMARK OFFICE

CERTIFICATE OF CORRECTION

PATENT NO. : 4,001,909

DATED : January 11, 1977

INVENTOR(S) : Wallace A. Erickson and David K. Erickson

It is certified that error appears in the above–identified patent and that said Letters Patent are hereby corrected as shown below:

Column 1, line 14, following "from", insert --a--;
Column 1, line 69, following "of", insert --the--.
Column 2, line 65, (Claim 3), "toothbrush" should be --device--; Column 2, line 68, (Claim 3), "project" should be --protect--.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*